US010914251B2

(12) United States Patent
Dudar

(10) Patent No.: US 10,914,251 B2
(45) Date of Patent: Feb. 9, 2021

(54) SYSTEMS AND METHODS FOR EGR VALVE DIAGNOSTICS

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 419 days.

(21) Appl. No.: 15/853,428

(22) Filed: Dec. 22, 2017

(65) Prior Publication Data

US 2019/0195153 A1 Jun. 27, 2019

(51) Int. Cl.

| | |
|---|---|
| ***F02D 41/00*** | (2006.01) |
| ***F02B 39/10*** | (2006.01) |
| ***F02M 26/08*** | (2016.01) |
| ***F02M 26/23*** | (2016.01) |
| ***F02M 26/43*** | (2016.01) |

(Continued)

(52) U.S. Cl.

CPC ..... *F02D 41/0077* (2013.01); *F02B 39/10* (2013.01); *F02D 41/0072* (2013.01); *F02D 41/1448* (2013.01); *F02D 41/1456* (2013.01); *F02M 26/08* (2016.02); *F02M 26/23* (2016.02); *F02M 26/43* (2016.02); *F02M 26/47* (2016.02); *F02M 26/48* (2016.02); *F02M 26/49* (2016.02); *F02D 41/0007* (2013.01); *F02D 41/0055* (2013.01); *F02D 41/042* (2013.01); *F02D 2041/0017* (2013.01)

(58) Field of Classification Search

CPC ..... F02D 41/0077; F02D 41/1456; F02D 41/1448; F02D 41/0072; F02D 41/0055; F02D 41/0007; F02D 41/042; F02D 2041/0017; F02B 39/10; F02M 26/49; F02M 26/48; F02M 26/47; F02M 26/43; F02M 26/23; F02M 26/08

See application file for complete search history.

(56) References Cited

U.S. PATENT DOCUMENTS 5,337,725 A * 8/1994 Narita ..... F02M 26/57 123/568.16
8,250,865 B2 * 8/2012 Pearson ..... F02M 26/24 123/41.08

(Continued)

FOREIGN PATENT DOCUMENTS

JP 2007032432 A * 2/2007
JP 2010196684 A * 9/2010

OTHER PUBLICATIONS

Dudar, A., "Systems and Methods for Conducting Onboard Engine Cleaning Routines in a Vehicle," U.S. Appl. No. 15/804,095, filed Nov. 6, 2017, 90 pages.

(Continued)

*Primary Examiner* — Lindsay M Low
*Assistant Examiner* — Brian P Monahon
(74) *Attorney, Agent, or Firm* — Geoffrey Brumbaugh; McCoy Russell LLP

(57) ABSTRACT

Methods and systems are provided for diagnosing degradation of an exhaust gas recirculation (EGR) valve. In one example, a method may include, during a vehicle key-off condition, routing compressed air through an EGR passage housing the EGR valve, and indicating degradation of the EGR valve based on a change in an estimated EGR pressure, upon a commanded change in EGR valve position.

19 Claims, 3 Drawing Sheets

(51) Int. Cl.

| | |
|---|---|
| ***F02M 26/47*** | (2016.01) |
| ***F02M 26/48*** | (2016.01) |
| ***F02M 26/49*** | (2016.01) |
| ***F02D 41/14*** | (2006.01) |
| ***F02D 41/04*** | (2006.01) |

(56) References Cited

U.S. PATENT DOCUMENTS

| | | | | |
|---|---|---|---|---|
| 9,145,135 | B2 * | 9/2015 | Sugimoto | B60W 20/40 |
| 9,267,453 | B2 | 2/2016 | Surnilla et al. | |
| 2001/0053954 | A1 * | 12/2001 | Kawaguchi | F02B 47/08 701/104 |
| 2002/0139357 | A1 * | 10/2002 | Kawaguchi | F02D 41/0055 123/568.21 |
| 2003/0019212 | A1 * | 1/2003 | Baeuerle | F02D 13/0261 60/608 |
| 2005/0210970 | A1 * | 9/2005 | Terada | F02D 41/0055 73/114.76 |
| 2008/0202482 | A1 * | 8/2008 | Furuta | F02B 47/08 123/568.16 |
| 2010/0186726 | A1 * | 7/2010 | Takagi | F02D 41/0055 123/568.16 |
| 2011/0011378 | A1 * | 1/2011 | Nakamura | F02D 41/1495 123/568.16 |
| 2012/0210987 | A1 * | 8/2012 | Miyashita | F02M 26/49 123/568.16 |
| 2013/0145830 | A1 * | 6/2013 | Kim | F02D 41/123 73/114.74 |
| 2014/0020363 | A1 * | 1/2014 | Sasaki | F01N 3/10 60/274 |
| 2014/0316682 | A1 * | 10/2014 | Whitney | F02D 11/105 701/108 |
| 2015/0053186 | A1 * | 2/2015 | Surnilla | F02M 26/07 123/568.21 |
| 2015/0233326 | A1 * | 8/2015 | Takaki | F02D 41/0007 123/559.2 |
| 2016/0230683 | A1 * | 8/2016 | Surnilla | F02D 41/0072 |
| 2016/0230684 | A1 * | 8/2016 | Surnilla | F02D 41/0065 |
| 2017/0211500 | A1 * | 7/2017 | Katou | F02D 41/221 |
| 2018/0128192 | A1 * | 5/2018 | Sugiyama | F02D 41/22 |
| 2018/0283326 | A1 * | 10/2018 | Miura | F02M 26/49 |
| 2019/0195153 | A1 * | 6/2019 | Dudar | F02M 26/08 |

OTHER PUBLICATIONS

Dudar, A., "Systems and Methods for Conducting Onboard Engine Cleaning Routines in a Vehicle," U.S. Appl. No. 15/804,110, filed Nov. 6, 2017, 89 pages.

Dudar, A., "Systems and Methods for Conducting Onboard Engine Cleaning Routines in a Vehicle," U.S. Appl. No. 15/804,143, filed Nov. 6, 2017, 88 pages.

* cited by examiner

SYSTEMS AND METHODS FOR EGR VALVE DIAGNOSTICS

FIELD

The present description relates generally to methods and systems for performing diagnostics of an exhaust gas recirculation (EGR) valve during a vehicle key-off condition.

BACKGROUND/SUMMARY

An exhaust gas recirculation (EGR) system in a vehicle powertrain function to recirculate exhaust gases back into an intake system of an engine, with the intent to reduce NOx emissions. However, while reducing NOx, the exhaust gases inherently comprise a dirty environment including the by-products of combustion. Thus, over time, soot and other carbon materials may build up in the EGR system. As one example, an EGR valve positioned in the EGR passage may become loaded with carbon buildup, which may in some examples cause the EGR valve to exhibit degradation (e.g. stuck in at least a partially open position, or stuck in a fully closed position). Undesired emissions may be increased in a vehicle with a clogged EGR passage or stuck closed EGR valve.

One example approach for diagnosing EGR valve operation is shown by Surnilla et al. in U.S. Pat. No. 9,267,453. The EGR valve is commanded to a closed position and a differential pressure across the EGR valve is adjusted via an intake throttle to a predetermined pressure. A leakage in the EGR valve may be detected and a rate of leakage flow may be estimated via an oxygen sensor located in the intake manifold, downstream of a charge air cooler.

However, the inventors herein have recognized potential issues with such systems. As one example, carrying out diagnostics of the EGR valve by adjusting the intake throttle opening and EGR valve position during a drive cycle may impact engine performance and driving experience. In the method shown by Surnilla et al., it may not be possible to differentiate between situations when the EGR valve is stuck in a completely closed position or is stuck in an open position. Since EGR is primarily supplied during vehicle conditions such as cruising in a highway, there may be prolonged periods of vehicle operation without EGR supply, thereby reducing the time available for carrying out diagnostics on the EGR system during a drive cycle.

In one example, the issues described above may be addressed by an engine method comprising: while an engine is not combusting fuel, testing for degradation of an exhaust gas recirculation (EGR) valve coupled between an air intake and an exhaust of the engine, during the test, turning the EGR valve to at least one predetermined position, and forcing compressed air into the EGR valve, and indicating presence or absence of the degradation based on one or more pressure readings across the EGR valve. In this way, by routing pressurized air through the EGR passage during vehicle key-off conditions, it is possible to detect degradation of the EGR valve.

In one example, a diagnostic routine of the EGR valve may be opportunistically carried out during vehicle key-off conditions when the engine is not operated. The engine may be a boosted engine comprising a turbine driven intake air compressor and an electrically driven intake air compressor (herein also referred to as a battery operated electric booster) that is selectively operated for providing additional boost during increased torque demand. During a vehicle-off condition, the electric booster may be operated to route pressurized air through the EGR passage. The engine cylinders may be parked with a maximum possible number of intake and exhaust valves closed. The diagnostic routine includes, commanding the EGR valve to a completely closed position and then estimating a first EGR pressure via a differential pressure sensor coupled across an orifice in the EGR passage. The EGR valve may be diagnosed to be stuck in an open position responsive to the first EGR pressure being higher than a first threshold pressure. The diagnostic routine further includes, commanding the EGR valve to a completely open position and then estimating a second EGR pressure via the differential pressure sensor. The EGR valve may be diagnosed to be stuck in a closed position responsive to the second EGR pressure being lower than a second threshold pressure. Upon detection of degradation of the EGR valve, during an immediately subsequent engine operation, the air fuel ratio may be adjusted to account for any undesired EGR flow.

In this way, by opportunistically using existing engine components, such as an electric booster and a differential pressure sensor, the need for additional sensors and/or equipment for diagnostics of an EGR valve may be reduced. By routing compressed air via the EGR passage, accumulated carbon and soot particles may be removed from the EGR passage, thereby cleaning the passage. The technical effect of carrying out diagnostics of the EGR valve during vehicle key-off conditions is that the EGR valve position may be altered without affecting engine performance. By identifying the position at which position the EGR valve is stuck, suitable mitigating steps may be undertaken, thereby reducing the possibility of engine system degradation. Overall, by regularly monitoring the health of the EGR valve, emissions quality and fuel efficiency may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
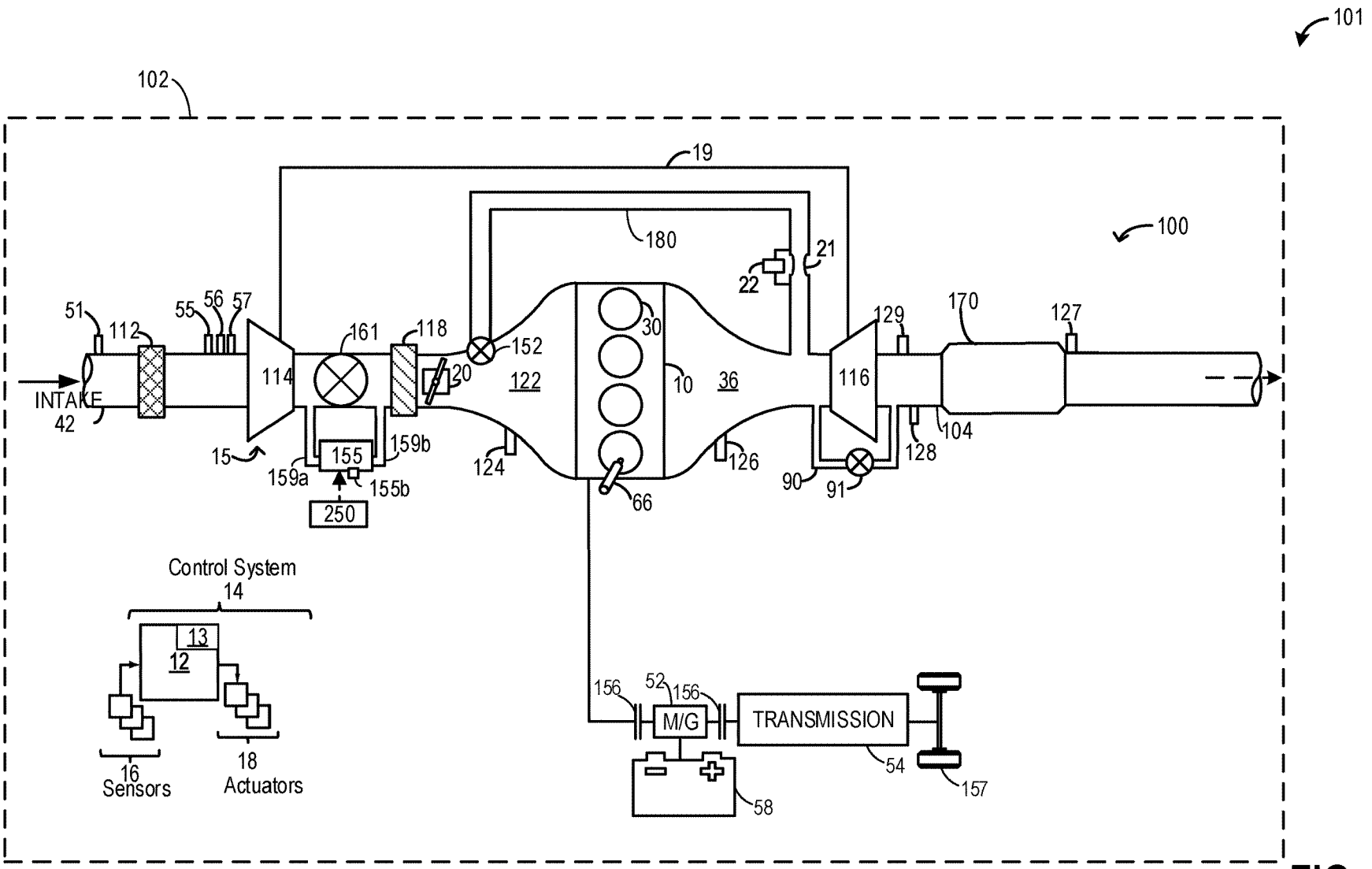
FIG. 1 schematically shows an example vehicle system with an electric booster.

The following description relates to systems and methods for diagnosing an exhaust gas recirculation (EGR) valve coupled to an EGR passage, included in an example engine illustrated in FIG. 1. During a vehicle key-off condition, an engine controller of the vehicle may be configured to perform an example routine to indicate degradation of the EGR valve. In an example, a diagnostic routine illustrated in FIG. 2 may be performed. In order to diagnose the EGR valve, the EGR valve may be commanded to change its degree of opening and the resulting changes in EGR pressure may be indicative of EGR valve condition. Example engine operations to enable EGR valve diagnostics during a vehicle key-off condition are shown in FIG. 3.

FIG. 1 shows a schematic view 101 of a vehicle system 102 with an example engine system 100 including an engine 10. In one example, the engine system 100 may be a diesel engine system. In another example, the engine system 100 may be a gasoline engine system. In the depicted embodiment, engine 10 is a boosted engine coupled to a turbocharger 15 including a compressor 114 driven by a turbine 116. Specifically, fresh air is introduced along intake passage 42 into engine 10 via air cleaner 112 and flows to compressor 114. The compressor may be any suitable intake-air compressor, such as a motor-driven or driveshaft driven supercharger compressor. In engine system 10, the compressor is a turbocharger compressor mechanically coupled to turbine 116 via a shaft 19, the turbine 116 driven by expanding engine exhaust.

As shown in FIG. 1, compressor 114 is coupled through charge-air cooler (CAC) 118 to throttle valve 20. Throttle valve 20 is coupled to engine intake manifold 122. From the compressor, the compressed air charge flows through the charge-air cooler 118 and the throttle valve 20 to the intake manifold 122. In the embodiment shown in FIG. 1, the pressure of the air charge within the intake manifold 122 is sensed by manifold air pressure (MAP) sensor 124. Temperature of ambient air entering the intake passage 42 may be estimated via an intake air temperature (IAT) sensor 51.

One or more sensors may be coupled to an inlet of compressor 114. For example, a temperature sensor 55 may be coupled to the inlet for estimating a compressor inlet temperature, and a pressure sensor 56 may be coupled to the inlet for estimating a compressor inlet pressure. As another example, an ambient humidity sensor 57 may be coupled to the inlet for estimating a humidity of aircharge entering the intake manifold. Still other sensors may include, for example, air-fuel ratio sensors, etc. In other examples, one or more of the compressor inlet conditions (such as humidity, temperature, pressure, etc.) may be inferred based on engine operating conditions. In addition, the sensors may estimate a temperature, pressure, humidity, and air-fuel ratio of the air charge mixture including fresh air, recirculated compressed air, and exhaust residuals received at the compressor inlet.

A wastegate actuator 91 may be actuated open to dump at least some exhaust pressure from upstream of the turbine to a location downstream of the turbine via wastegate 90. By reducing exhaust pressure upstream of the turbine, turbine speed can be reduced, which in turn helps to reduce compressor surge.

To assist the turbocharger 15, an additional intake air compressor, herein also referred to as an electric booster 155 may be incorporated into the vehicle propulsion system. Electric booster 155 may be powered via an onboard energy storage device 250, which may comprise a battery, capacitor, supercapacitor, etc. The electric booster may include a compressor driven by an electric motor. A speed of operation of the electric booster may include adjusting a speed of operation of the electric motor, the electric motor operated via the on-board energy storage device 250.

In one example, electric booster 155 may be actuated in response to a demand for increased wheel torque, in order to provide the desired boost air rapidly to the engine while the turbocharger turbine spools up. As a result, the increased torque can be met without incurring the turbo lag which may otherwise have occurred if the assist from the electric booster was not available. In such an example, responsive to the turbocharger spooling up to a threshold speed (e.g. 70,000 rpm), the electric booster 155 may be actuated off, or deactivated. More specifically, operational control of the electric booster 155 may be achieved based on command signals (e.g. duty cycle or pulse width signals) received from the vehicle controller (e.g. controller 12). For example, the controller may send a signal to an electric booster actuator 155*b*, which may actuate on the electric booster. In another example, the controller may send a signal to the electric booster actuator 155*b*, which may actuate off the electric booster. In one example the electric booster actuator may comprise an electric motor which drives the compression of air.

Electric booster 155 may be positioned between a first electric booster conduit 159*a*, and a second electric booster conduit 159*b*. First electric booster conduit 159*a* may fluidically couple intake passage 42 to electric booster 155 upstream of electric booster bypass valve 161. Second electric booster conduit 159*b* may fluidically couple electric booster 155 to intake passage 42 downstream of electric booster bypass valve 161. As an example, air may be drawn into electric booster 155 via first electric booster conduit 159*a* upstream of electric booster bypass valve 161, and compressed air may exit electric booster 155 and be routed via second electric booster conduit to intake passage 42 downstream of electric booster bypass valve 161. In this way, compressed air may be routed to engine intake 122.

In circumstances where the electric booster 155 is activated to provide boost more rapidly than if the turbocharger 15 were solely relied upon, it may be understood that electric booster bypass valve 161 may be commanded closed while electric booster 155 is activated. In this way, intake air may flow through turbocharger 15 and through electric booster 155. Once the turbocharger reaches the threshold speed, the electric booster 155 may be turned off, and the electric booster bypass valve 161 may be commanded open.

Intake manifold 122 is coupled to a series of combustion chambers 30 through a series of intake valves (not shown). The combustion chambers are further coupled to exhaust manifold 36 via a series of exhaust valves (not shown). In the depicted embodiment, a single exhaust manifold 36 is shown. However, in other embodiments, the exhaust manifold may include a plurality of exhaust manifold sections. Configurations having a plurality of exhaust manifold sections may enable effluent from different combustion chambers to be directed to different locations in the engine system.

In one embodiment, each of the exhaust and intake valves may be electronically actuated or controlled. In another embodiment, each of the exhaust and intake valves may be cam actuated or controlled. Whether electronically actuated or cam actuated, the timing of exhaust and intake valve opening and closure may be adjusted as needed for desired combustion and emissions-control performance.

Combustion chambers 30 may be supplied with one or more fuels, such as gasoline, alcohol fuel blends, diesel, biodiesel, compressed natural gas, etc., via injector 66. Fuel may be supplied to the combustion chambers via direct injection, port injection, throttle valve-body injection, or any combination thereof. In the combustion chambers, combustion may be initiated via spark ignition and/or compression ignition.

As shown in FIG. 1, exhaust from the one or more exhaust manifold sections may be directed to turbine 116 to drive the turbine. The combined flow from the turbine and the wastegate then flows through emission control device 170. In one example, the emission control device 170 may be a light-off catalyst. In general, the exhaust after-treatment device 170 is configured to catalytically treat the exhaust flow, and thereby reduce an amount of one or more substances in the exhaust flow. For example, the exhaust after-treatment device 170 may be configured to trap NOx from the exhaust flow when the exhaust flow is lean, and to reduce the trapped NOx when the exhaust flow is rich. In other examples, the exhaust after-treatment device 170 may be configured to disproportionate NOx or to selectively reduce NOx with the aid of a reducing agent. In still other examples, the exhaust after-treatment device 170 may be configured to oxidize residual hydrocarbons and/or carbon monoxide in the exhaust flow. Different exhaust after-treatment catalysts having any such functionality may be arranged in wash coats or elsewhere in the exhaust after-treatment stages, either separately or together. In some embodiments, the exhaust after-treatment stages may include a regeneratable soot filter configured to trap and oxidize soot particles in the exhaust flow.

Exhaust gas recirculation (EGR) delivery passage 180 may be coupled to the exhaust passage 104 upstream of turbine 116 to provide high pressure EGR (HP-EGR) to the engine intake manifold, downstream of compressor 114. EGR passage 180 may include one or more flow restriction regions (orifice) 21. One or more pressure sensors 22 may be coupled across flow restriction region 21. In one example, the pressure sensor 22 may be a differential pressure sensor. The differential pressure sensor may be used to determine a pressure of airflow through the orifice 21. The overall volumetric flow rate through EGR passage 180 may be estimated based on the pressure of airflow through the orifice 21. An EGR valve 152 may be coupled to the EGR passage 181 at the junction of the EGR passage 180 and the intake passage 42. EGR valve 152 may be opened to admit a controlled amount of exhaust to the compressor outlet for desirable combustion and emissions control performance. EGR valve 152 may be configured as a continuously variable valve or as an on/off valve.

In further embodiments, the engine system may include a low pressure EGR (LP-EGR) flow path wherein exhaust gas is drawn from downstream of turbine 116 and recirculated to the engine intake manifold, upstream of compressor 114.

A plurality of other sensors may also be coupled to EGR passage 180 for providing details regarding the composition and condition of the EGR. For example, a temperature sensor may be provided for determining a temperature of the EGR, a humidity sensor may be provided for determining a humidity or water content of the EGR, and an air-fuel ratio sensor may be provided for estimating an air-fuel ratio of the EGR. Alternatively, EGR conditions may be inferred by the one or more temperature, pressure, humidity, and air-fuel ratio sensors coupled to the compressor inlet.

As exhaust gas is recirculated via the EGR passage 180, over time, soot and other carbon materials may build up in the EGR system, such as in the orifice 21. As one example, the EGR valve 152 may become loaded with carbon buildup, which may in some examples cause the EGR valve to exhibit degradation (e.g. stuck in at least a partially open position, or stuck in a fully closed position). A diagnostic routine for the EGR valve 152 may be periodically or opportunistically carried out during a vehicle key-off condition. While an engine is not combusting fuel, compressed air may be forced through the EGR passage by operating the electric booster 155 via the electric booster actuator 155*b* (electric motor). A first EGR pressure may be estimated when the EGR valve is in the completely closed position, and the EGR valve may be indicated as degraded responsive to the first EGR pressure being higher than a first threshold pressure. A second EGR pressure may be estimated when the EGR valve is in the completely open position, and the EGR valve may be indicated as degraded responsive to the second EGR pressure being lower than a second threshold pressure. An absence of degradation of the EGR valve may be indicated responsive to each of the first EGR pressure being substantially equal to the first threshold pressure and the second EGR pressure being substantially equal to the second threshold pressure. Each of the first EGR pressure and the second EGR pressure may be estimated via the differential pressure sensor 22 coupled across an orifice 21 in the EGR passage 180. Details of a diagnostics routine for the EGR valve 152 is described in relation to FIG. 2.

A plurality of sensors, including an exhaust temperature sensor 128, an exhaust oxygen sensor, an exhaust flow sensor, and exhaust pressure sensor 129 may be coupled to the main exhaust passage 104. The oxygen sensor may be linear oxygen sensors or UEGO (universal or wide-range exhaust gas oxygen), two-state oxygen sensors or EGO, HEGO (heated EGO), a NOx, HC, or CO sensors.

Engine system 100 may further include control system 14. Control system 14 is shown receiving information from a plurality of sensors 16 (various examples of which are described herein) and sending control signals to a plurality of actuators 18 (various examples of which are described herein). As one example, sensors 16 may include exhaust gas sensor 126 located upstream of the turbine 116, MAP sensor 124, exhaust temperature sensor 128, exhaust pressure sensor 129, compressor inlet temperature sensor 55, compressor inlet pressure sensor 56, ambient humidity sensor 57, IAT sensor 51, differential pressure sensor 22, engine coolant temperature sensor, and EGR sensor. Other sensors such as additional pressure, temperature, air/fuel ratio, and composition sensors may be coupled to various locations in engine system 100. In addition, sensors coupled to the exterior of the vehicle system such as the rain sensor (windshield sensor) 130 may be used to estimate ambient humidity.

The actuators 18 may include, for example, electric booster bypass valve 161, throttle 20, electric booster actuator 155*b*, EGR valve 152, wastegate 92, and fuel injector 66. The control system 14 may include a controller 12. The controller 12 may receive input data from the various sensors, process the input data, and trigger various actuators in response to the processed input data based on instruction or code programmed therein corresponding to one or more routines. In one example, during a vehicle key-off condition, the controller 12 may send a signal to the electric booster actuator 155*b* to actuate the electric booster 155 to flow compressed air via the EGR passage 180. During operation of the electric booster 155, the controller 12 may send a signal to the EGR valve 152 to change the position of the EGR valve 152 and to detect degradation of the EGR valve 152 based on a corresponding change in EGR pressure as estimated via the differential pressure sensor 22.

In some examples, vehicle 102 may be a hybrid vehicle with multiple sources of torque available to one or more vehicle wheels 157. In other examples, vehicle 102 is a conventional vehicle with only an engine, or an electric vehicle with only electric machine(s). In the example shown, vehicle 102 includes engine 10 and an electric machine 52. Electric machine 52 may be a motor or a motor/generator. Crankshaft of engine 10 and electric machine 52 are connected via a transmission 46 to vehicle wheels 157 when one or more clutches 156 are engaged. In the depicted example, a first clutch 156 is provided between crankshaft and electric machine 52, and a second clutch 156 is provided between electric machine 52 and transmission 46. Controller 12 may send a signal to an actuator of each clutch 156 to engage or disengage the clutch, so as to connect or disconnect crankshaft from electric machine 52 and the components connected thereto, and/or connect or disconnect electric machine 52 from transmission 46 and the components connected thereto. Transmission 46 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 157. Electric machine 52 may also be operated as a generator to provide electrical power to charge traction battery 58, for example during a braking operation.

In this way, the components of FIG. 1 enable a system for a hybrid vehicle comprising: a vehicle, an engine including one or more cylinders, an intake manifold, and an exhaust manifold, an intake passage including a compressor and a charge air cooler (CAC) downstream of the compressor, a conduit coupled to the intake passage downstream of the compressor and upstream of the CAC, the conduit including a motor-driven electric booster, an electric booster bypass valve coupled at a junction of the intake passage and the conduit, an exhaust gas recirculation (EGR) passage coupling the exhaust manifold to the intake manifold, downstream of the compressor, the EGR passage including an EGR valve and an orifice, a differential pressure sensor coupled across the orifice in the EGR passage. The system further including a controller with computer readable instructions stored on non-transitory memory for: while operating of the electric booster during a vehicle key-off condition, commanding the EGR valve to a completely closed position, sensing EGR pressure via the differential pressure sensor after the commanded closing of the EGR valve, and indicating that the EGR valve is stuck at an open position in response to the sensed EGR pressure being higher than a first threshold pressure.

Figure 2:
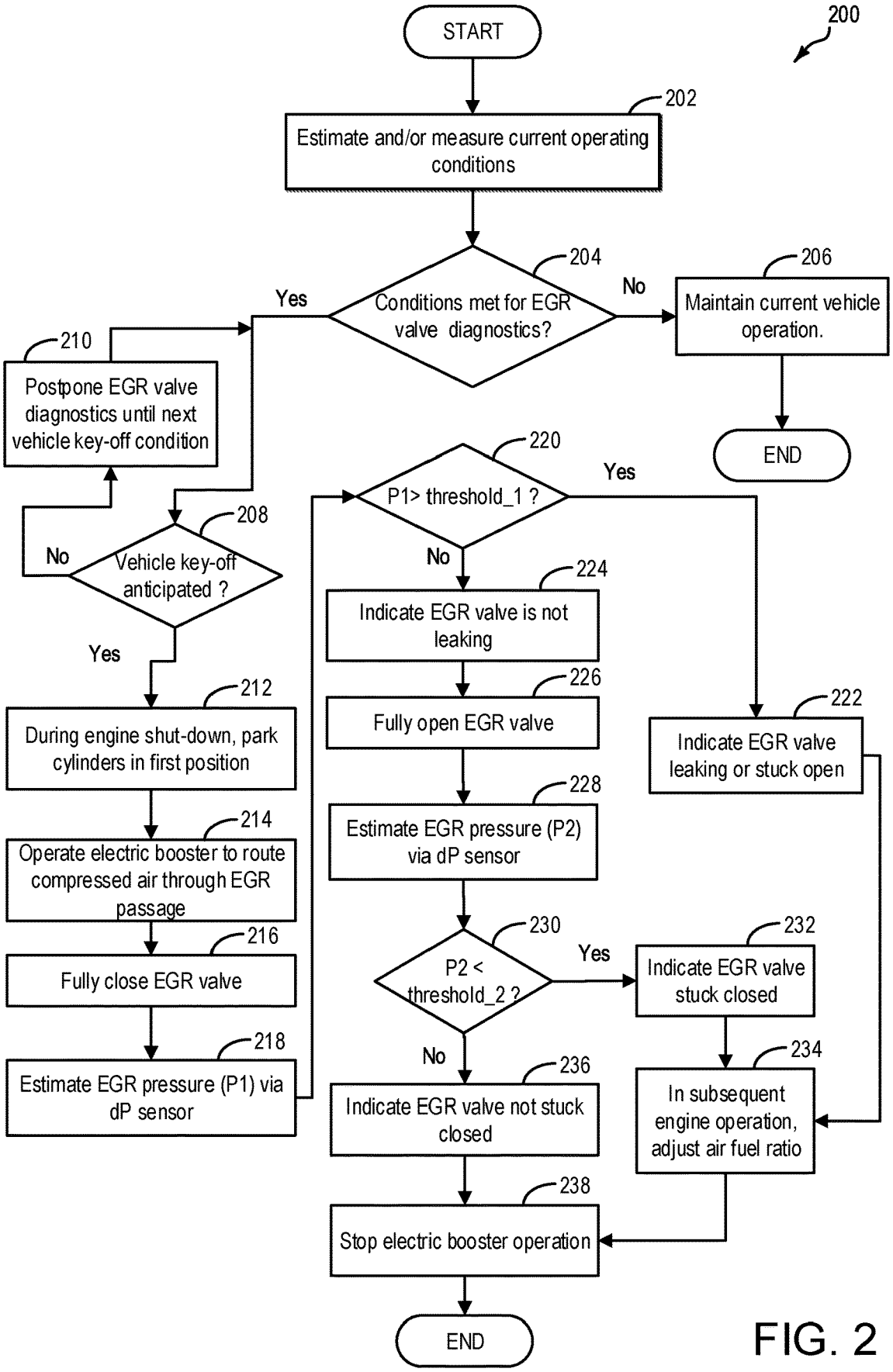
FIG. 2 shows a flow chart illustrating a diagnostic routine for diagnosing a degraded exhaust gas recirculation (EGR) valve.
Figure 3:
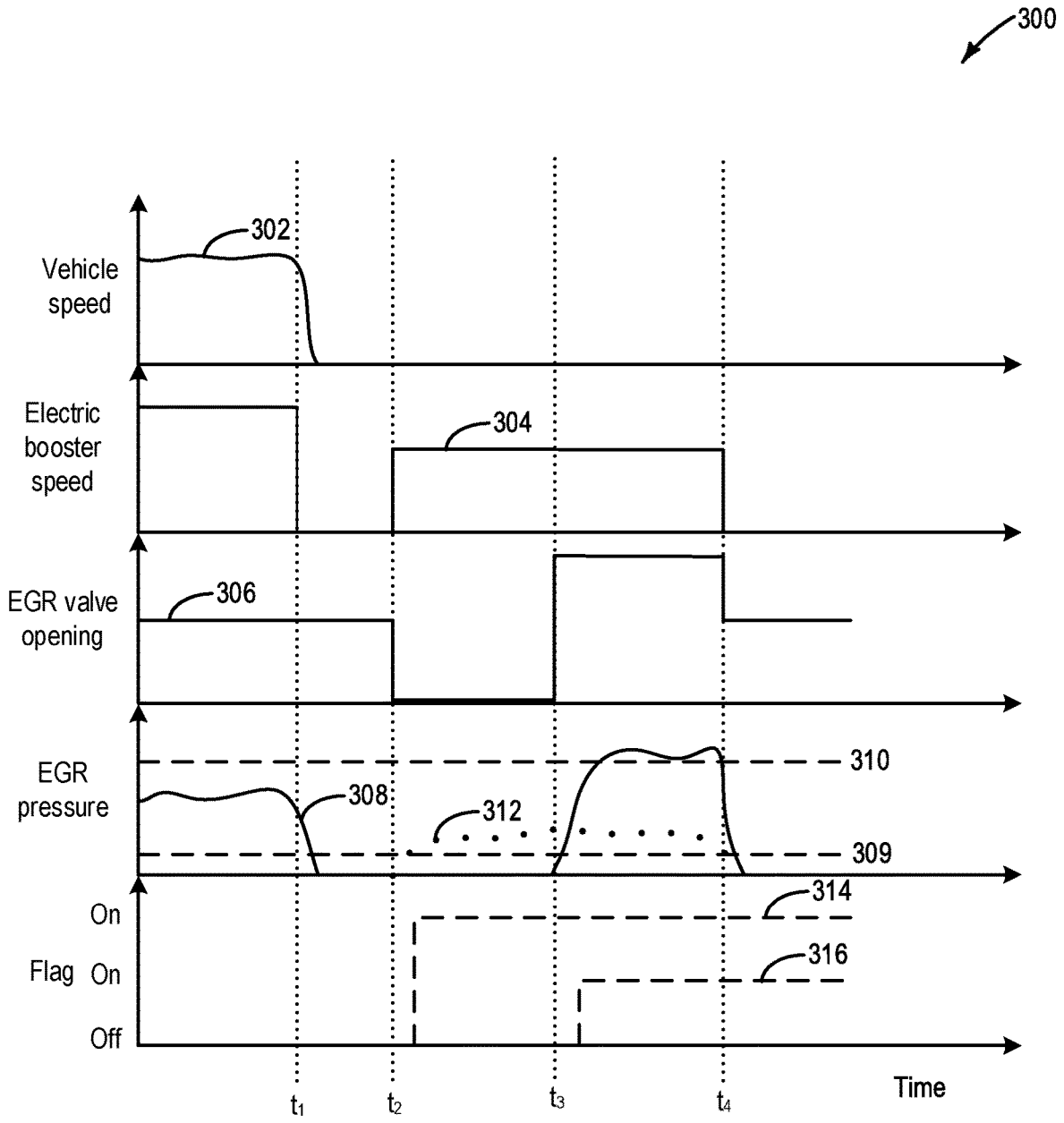
FIG. 3 shows an example diagnosis of an EGR valve during an engine-off condition, according to the present disclosure.

FIG. 2 shows an example method 200 that may be implemented for detecting any degradation of an exhaust gas recirculation (EGR) valve (such as EGR valve 152 in FIG. 1) coupled to an EGR passage (such as EGR passage 180 in FIG. 1). Instructions for carrying out method 200 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 202, method 200 includes determining engine and vehicle operating conditions. Operating conditions may include engine speed, engine load, vehicle speed, pedal position, throttle position, mass air flow rate, air-fuel ratio, engine temperature, EGR pressure, oil temperature, etc.

Proceeding to 204, method 200 may include determining whether conditions are met for conducting an EGR valve diagnostics. Conditions for conducting the EGR valve diagnostic routine may include an indication of low EGR flow, as monitored via a pressure sensor (such as differential pressure sensor 22) in the EGR passage. For example, an expected amount of EGR flow in the absence of carbon deposits associated with the EGR valve and/or in the EGR passage may be stored at the controller in the form of a lookup table, comprising expected flow rates at various engine speeds and/or other operating conditions. Low EGR flow may comprise a level of EGR flow that differs from an expected EGR flow for a particular engine operating condition, by a threshold, for example differing by greater than 5%, or differing by greater than 10%. In another example, conditions being met for conducting the EGR diagnostics may include an indication of a degraded EGR system, evidenced by, for example, a rough idle or in some examples a stall condition. In yet another example, conditions for carrying out the EGR valve diagnostic routine may include pre-ignition or misfire as detected in engine cylinders via a knock sensor. Further, conditions for carrying out the EGR valve diagnostic routine may include a higher than threshold (such as greater than 5%) increase in exhaust gas NOx content as estimated via a NOx sensor coupled to an exhaust emissions control device.

Conditions being met may additionally or alternatively include an indication that a threshold duration (e.g. 1 day, 2 days, 5 days, 10 days, 15 days, greater than 20 days but less than 30 days, etc.) has elapsed since a prior EGR valve diagnostic.

If it is determined that the conditions are not met for carrying out a EGR diagnostic routine, at 206, current vehicle operation may be maintained. In one example, EGR may be supplied to the intake manifold based on engine dilution demands. The controller may determine a level of EGR desired based on engine operating conditions including engine speed, engine load, and engine temperature. The controller may use a look-up table to determine an opening of the EGR valve, the inputs being engine speed, engine load, and engine temperature and the output being EGR valve position.

In another example, an electric booster (such as electric booster 155 in FIG. 1) may be operated as required to provide boost assist during an increased torque demand. The electric booster may be coupled to a conduit parallel to an intake passage, the conduit coupled to the intake passage downstream of an intake compressor and upstream of a charge air cooler. During conditions when the boost pressure provided by operating the turbocharger (such as intake compressor 114 and exhaust turbine 116 in FIG. 1) is lower than a desired boost pressure, the electric booster may be operated using energy from an onboard energy storage device (such as energy storage device 250 in FIG. 1) to provide the desired boost. The speed and duration of operation of the electric booster may be adjusted based on turbocharger speed, and torque demand as estimated via a pedal position sensor. In one example, the speed and duration of operation of the electric booster may be increased with an increase in the torque demand and a decrease in turbocharger speed. In another example, the speed and duration of operation of the electric booster may be decreased with a decrease in the torque demand and an increase in turbocharger speed.

If it is determined that conditions are met for carrying out EGR valve diagnostics, at 208, the routine may include determining if a vehicle key-off condition is anticipated. In one example, anticipating a key-off condition may include a tip-out event of the accelerator pedal followed by application of brakes to stop the vehicle (reduce the vehicle speed to zero) from bring propelled. In addition, in anticipation of the vehicle key-off, the transmission may be shifted to park. Also, the ignition switch may be turned off.

If it is determined that a vehicle key-off condition is not anticipated, at 210, the EGR valve diagnostics may be postponed until the next vehicle key-off condition. Current vehicle operating conditions may be continued. If it is determined that a vehicle key-off condition is anticipated, it may be inferred that the engine may be shut down. The controller may send signals to the fuel injectors and to the spark plugs coupled to the engine cylinders to suspend fueling and spark, respectively. At 212, during the engine shut-down, the controller may send a signal to the cam actuators coupled to the intake and exhaust valves of the cylinders to park the cylinders at a pre-determined first position. The first position may include a position with the maximum number of intake and exhaust valves in sealed conditions such as at the top dead center (TDC) of the compression stroke. In one example, the controller may send a signal to a starter motor coupled to the crankshaft to crank the engine after fueling and spark has been suspended until the cylinders reach the first position and then the operation of the starter motor may be suspended (as the cylinders are parked in the first position). In one example, the engine may be rotated unfueled via an electric motor (such as hybrid electric vehicle electric motor) until the cylinders reach the first position. Once the engine is shut-down, at 214, the electric booster may be operated to route compressed air from the intake manifold to the exhaust manifold via the EGR passage. The controller may send a signal to the electric booster actuator (such as actuator 155*b* in FIG. 1) to actuate the electric booster using energy from the energy storage device coupled to the electric booster. As the ambient air entering the intake manifold flows through the electric booster, the air is pressurized (compressed). The intake throttle opening may be increased to a wide open position to maximize the amount of air entering the intake manifold. By parking the engine cylinders at a position with the maximum number of intake and exhaust valves sealed, a first, higher portion of the compressed air may be forced to the exhaust manifold via the EGR passage while a smaller, remaining portion of compressed air may flow through the engine cylinders. The pre-determined speed of rotation of the electric booster during the diagnostic routine may be lower than the speed of rotation of the electric booster when operated to compensate for the lag of the mechanical turbocharger. In one example, the speed of rotation of the electric booster during the diagnostics routine may be 2500 RPM. By operating the electric booster at a lower speed, power consumption may be reduced and noise generation during operation of the electric booster may also be reduced.

At 216, the controller may send a signal to the actuator coupled to the EGR valve to actuate the EGR valve to a completely closed position. If at engine shut-down the EGR valve was already in the completely closed position, the valve may be maintained in that position. Upon closing the EGR valve, at 218, pressure of compressed air flowing via the EGR passage (first EGR pressure P1) may be estimated via a differential pressure sensor (such as pressure sensor 22 in FIG. 1) coupled across an orifice in the EGR passage. A drop in pressure across the orifice (EGR pressure), as estimated by the differential pressure sensor, may be directly proportional to the rate of flow of air through the EGR valve in the EGR passage. Since the EGR valve is commanded to the closed position, air flow from the intake manifold to the exhaust manifold via the EGR may be restricted.

At 220, the routine includes determining if the first EGR pressure P1 is lower than a first threshold pressure (threshold_1). As an example, the first threshold pressure may be established via the differential pressure sensor upon installation of the EGR valve. During a vehicle key-off condition after installation of the EGR valve, the engine may be parked at the first position with the maximum number of intake and exhaust valves sealed, the EGR valve may be closed, and then the electric booster may be operated at the pre-determined speed to route compressed air via the EGR passage. The EGR pressure may be estimated by the differential pressure sensor and stored in the controller memory as the first threshold pressure. As an example, as the first threshold pressure is estimated with the EGR valve closed, there may be no significant air flow through the EGR passage, and the first threshold pressure may be zero.

If it is determined that the first pressure P1 is higher than the first threshold pressure, it may be inferred that even when the EGR valve is commanded to the closed position, there is air flow through the EGR passage causing a pressure drop across the EGR passage orifice. Air flow through the EGR passage during an EGR valve closed condition may be caused due to the EGR valve being stuck in an open position or due to a leak in the EGR valve. Therefore, at 222, it may be indicated that the EGR valve is leaking or that the EGR valve is stuck in an open position even when it is commanded to be closed. A diagnostic code, such as a flag, may be set indicating that the EGR valve is stuck open or is leaking.

In one example, as compressed air flows through the EGR passage, any particulate deposit on the EGR valve (such as carbon build up) may be removed with the air stream causing the EGR valve to close. The air pressure may route the particles from the EGR passage to the atmosphere via the exhaust manifold, thereby cleaning the EGR passage. If the EGR valve is stuck open due to deposition of particulate matter, upon removal of the particulate matter, the EGR valve may move to the commanded closed position. If a stuck open EGR valve is closed by the routing of the compressed air, the first EGR pressure may decrease to below the first threshold pressure.

If it is determined that the first EGR pressure is below the first pressure threshold, it may be inferred that the EGR valve could be actuated to a completely closed position and the compressed air may not be flowing through the EGR passage. Therefore, at 224, it may be indicated that the EGR valve is not leaking or is not stuck in a completely open position even when it is commanded to close.

At 226, the controller may send a signal to the actuator coupled to the EGR valve to actuate the EGR valve to a fully open position. Upon opening the EGR valve, at 228, pressure of compressed air flowing via the EGR passage (second EGR pressure P2) may be estimated via the differential pressure sensor. Since the EGR valve is commanded to a completely open position, compressed air may start flowing from the intake manifold to the exhaust manifold via the EGR passage.

At 230, the routine includes determining if the second EGR pressure P2 is lower than a second threshold pressure (threshold_2). As an example, the second threshold pressure may be established via the differential pressure sensor upon installation of the EGR valve. During a vehicle key-off condition after installation of the EGR valve, the engine may be parked at the first position with the maximum number of intake and exhaust valves sealed, the EGR valve may be completely opened, and then the electric booster may be operated at the pre-determined speed to route compressed air via the EGR passage. The EGR pressure may be estimated by the differential pressure sensor and stored in the controller memory as the second threshold pressure.

Each of the first threshold pressure and the second threshold pressure may be estimated within a first threshold duration since installation of the EGR valve. In one example, the first threshold duration may be one day since the installation of the EGR valve. Alternatively, the first threshold pressure and the second threshold pressure may be estimated within a first threshold distance of travel (of the vehicle) since installation of the EGR valve. In one example, the first threshold distance may be 30 miles since the installation of the EGR valve. In one example, the second threshold pressure may be higher than the first threshold pressure.

In this way, the first threshold pressure and the second threshold pressure may be calibrated during an engine-off condition within a threshold duration after installation of the EGR valve by operating the electric booster, the first threshold pressure being the differential pressure sensor reading with the EGR valve completely closed and the second threshold pressure being the differential pressure sensor reading with the EGR valve completely open.

In one example, the routine may also determine if a difference between the second EGR pressure and the first EGR pressure is higher than a threshold difference. As the EGR valve is actuated from the completely open position to the completely closed position, compressed air may start flowing via the EGR passage causing the EGR pressure to increase. The threshold difference may be the non-zero difference between the second threshold pressure and the first threshold pressure.

If it is determined that the second EGR pressure P2 is lower than the second threshold pressure, it may be inferred that even after opening the EGR valve, air flow through the EGR passage may not have increased to the expected level (the second threshold pressure). Therefore, at 232, it may be indicated that the EGR valve is stuck in a closed position or there is a blockage in the EGR valve. Also, it may be indicated that EGR valve is degraded responsive to the difference between the second EGR pressure and the first EGR pressure being lower than the threshold difference. A diagnostic code, such as a flag, may be set indicating that the EGR valve is stuck closed or is blocked.

In one example, as compressed air flows through the EGR passage, the air pressure may force the stuck closed EGR valve to open up. The air pressure may also remove any particles blocking the EGR valve. If a stuck closed EGR valve is opened by the routing of the compressed air, the second EGR pressure may increase to above the second threshold pressure.

Upon indication that the EGR valve is degraded such as stuck in a completely closed position, stuck in an open position, or is leaking, during an immediately subsequent engine operation, a desired level of engine dilation may not be attained by supplying a desired amount of EGR. Engine operating parameters may be adjusted to account for the lower than desired (if EGR valve is stuck closed) or higher than desired (if EGR valve is stuck open) amount of EGR supplied to the engine intake. In one example, at 234, during an immediately subsequent engine operation, air fuel ratio may be adjusted taking into account the EGR flow. In one example, if due to a leaking EGR valve, a higher than desired volume of EGR is supplied to the engine cylinders, the controller may send a signal to the actuator coupled to the intake throttle plate to increase the opening of the throttle plate to adjust the air fuel ratio to leaner than stoichiometry. In another example, if due to a blocked EGR valve, a lower than desired volume of EGR is supplied to the engine cylinders, the controller may send a signal to the actuator coupled to the fuel injectors to increase the pulse width of the fuel injection in order to adjust the air fuel ratio to richer than stoichiometry. If at step 230, it is determined that the second EGR pressure is higher than the second threshold pressure or if the difference between the second EGR pressure and the first EGR pressure is higher than the threshold difference, it may be inferred that the compressed air flows through the EGR valve without any restrictions. Therefore, at 236, it may be indicated that the EGR valve is not stuck closed and is shifting to the completely open position as commanded. At 238, the diagnostic routine is completed and the electric booster may no longer be rotated. The controller may send a signal to the electric booster actuator to stop rotating the electric booster and the engine may be returned to a shutdown condition.

In this way, in a first condition, an exhaust gas recirculation (EGR) valve positioned in an EGR passage may be closed, compressed air may be routed through the EGR passage, and it may be indicated that the EGR valve is stuck open responsive to a presence of pressure change in the EGR passage, and in a second condition, the EGR valve may be opened, compressed air may be routed through the EGR passage, and it may be indicated that the EGR valve is stuck closed in response to the absence of pressure change in the EGR passage. In the first condition, the EGR valve is in an open position during the vehicle key-off condition and in the second condition the EGR valve is in a closed position during the vehicle key-off condition. The presence of pressure change in the EGR passage may include a higher than threshold change in pressure across the orifice in the EGR passage after closing the EGR valve, and the absence of pressure change in the EGR passage may include a lower than threshold change in pressure across the orifice in the EGR passage after opening the EGR valve.

FIG. 3 shows an example timeline 300 illustrating diagnostics of an exhaust gas recirculation (EGR) valve (such as EGR valve 152 in FIG. 1). The EGR valve is coupled to an EGR passage, the EGR passage configured to route at least a portion of exhaust gas from the exhaust to the intake. The horizontal (x-axis) denotes time and the vertical markers t1-t4 identify significant times in the EGR valve diagnostic routine.

The first plot, line 302, shows variation in vehicle speed over time. The second plot, line 304, shows a speed of operation of an electric booster (such as electric booster 155) in FIG. 1. The third plot, line 306, shows a degree of opening of the EGR valve. The fourth plot, line 308, shows EGR pressure as estimated via a differential pressure sensor (such as pressure sensor 22 in FIG. 1) coupled across an orifice in the EGR passage. Dashed line 309 shows a first threshold pressure and dashed line 310 shows a second threshold pressure. The first threshold pressure is established upon installation of the EGR valve by routing compressed air through the EGR passage with the EGR valve in the completely closed position and wherein the second threshold pressure is established upon installation of the EGR valve by routing compressed air through the EGR passage with the EGR valve in the completely open position, each of the first threshold and the second threshold estimated via the differential pressure sensor. The fourth plot, dashed lines 314 and 316, show flags indicating degradation of the EGR valve.

Prior to time t1, the vehicle is propelled using engine torque. The electric booster is operated to provide the desired boost pressure. The EGR valve may be opened to allow exhaust gas to be recirculated to the intake manifold. The degree of opening of the EGR valve is based on engine operating parameters including engine speed, engine load, and engine temperature. The controller estimates the degree of opening of the EGR valve using a look-up table with engine speed, engine load, and engine temperature as inputs and the degree of opening of the EGR valve as the output. The EGR pressure is directly proportional to the opening of the EGR valve and the corresponding volume of EGR flowing through the EGR passage. Since degradation of the EGR valve is not detected, the flag is maintained in the off state.

At time t1, the vehicle is stopped (keyed-off). As engine torque is no longer desired for vehicle operation, the electric booster operation is also stopped. Between time t1 and t2, the vehicle is not propelled using engine torque and/or machine torque. As the vehicle is not operated, the engine is non combusting and EGR is no longer supplied. As EGR no longer flows through the EGR passage, the EGR pressure reduces to zero.

At time t2, after a threshold duration has elapsed since the vehicle key-off (the duration between time t1 and t2), EGR valve diagnostic is initiated. The controller sends a signal to the electric booster actuator to rotate the electric booster. During the diagnostic routine, the electric booster is operated at a speed lower than the speed at which the electric booster is rotated to provide boost (such as prior to time t1). Also, at time t2, the controller sends a signal to the actuator coupled to the EGR valve to actuate the EGR valve to a completely closed position. As the EGR valve is completely closed, compressed air from the electric booster does not flow from the intake manifold to the exhaust manifold via the EGR passage. Therefore, there is no significant change in EGR pressure (from zero) between time t2 and t3. Since the EGR pressure remains below the first threshold pressure 309, it is inferred that the EGR valve is not leaking or is not stuck in an open position.

However, if there was a leak in the EGR valve, even when it is actuated to a completely closed position, compressed air from the electric booster would have passed through the EGR passage and the EGR valve. Due to air flow via the leaky EGR valve, the EGR pressure would have been higher than the first threshold pressure 309. In response to the higher than first threshold 309 EGR pressure, between time t2 and t3, the flag 314 denoting that the EGR valve is leaking would have been raised and a diagnostic code would have been set.

Upon confirmation that the EGR valve is not leaking or is not stuck in an open position, continuing with the diagnostic routine, at time t3, the controller sends a signal to the actuator coupled to the EGR valve to actuate the valve to a completely open position. As the EGR valve is completely opened, compressed air starts flowing through the EGR passage and the EGR valve causing the EGR pressure to change. Due to the air flow through the EGR passage, the EGR pressure (as shown by dotted line 312) increases to above the second threshold pressure 310. Between time t3 and t4, in response to the higher than second threshold 310 EGR pressure, it is inferred that the EGR valve is not blocked or is not stuck in a closed position.

However, if there was a blockage in the EGR valve or if the EGR valve was stuck in the closed position, even when it is actuated to a completely open position, an expected volume of compressed air from the electric booster would not have passed through the EGR passage and the EGR valve. Due to reduced air flow via the blocked EGR valve, the EGR pressure would have been lower than the second threshold pressure 310. In response to the lower than second threshold 310 EGR pressure, between time t3 and t4, the flag 316 denoting that the EGR valve is stuck closed (or blocked) would have been raised and a diagnostic code would have been set.

At time t4, the diagnostic routine is completed. The controller sends a signal to the electric booster actuator to stop rotating the electric booster. The EGR valve is actuated to the position prior to the initiation of the diagnostic routine (prior to time t2). After time t4, the vehicle is maintained in the keyed-off condition and the electric motor is not rotated.

In this way, the position of the EGR valve may be altered and EGR valve diagnostics may be carried out during an engine non-combusting condition without affecting engine performance. By identifying the nature of degradation of the EGR valve, air-fuel ratio may be suitably adjusted during subsequent engine operations to improve fuel efficiency and emissions quality. The technical effect of using existing engine components such as an electric booster and a differential pressure sensor for EGR valve diagnostics is that the need for additional sensors and/or equipment for diagnostics of an EGR valve may be reduced. Overall, by regularly monitoring the health of the EGR valve, emissions quality and fuel efficiency may be improved.

An example method comprises: while an engine is not combusting fuel, testing for degradation of an exhaust gas recirculation (EGR) valve coupled between an air intake and an exhaust of the engine, during the test, turning the EGR valve to at least one predetermined position and forcing compressed air into the EGR valve, and indicating presence or absence of the degradation based on one or more pressure readings across the EGR valve. In any preceding example, additionally or optionally, the EGR valve is coupled to an EGR passage, the EGR passage configured to route at least a portion of exhaust gas from the exhaust to the intake. In any or all of the preceding examples, additionally or optionally, forcing the compressed air includes forcing compressed air through the EGR passage by operating an electric booster via an electric motor, wherein the electric booster is coupled to a conduit parallel to an intake passage, the conduit coupled to the intake passage downstream of an intake compressor and upstream of a charge air cooler. In any or all of the preceding examples, additionally or optionally, the predetermined position includes one of a completely closed position and a completely open position. In any or all of the preceding examples, additionally or optionally, indicating the presence of the degradation includes, estimating a first EGR pressure when the EGR valve is in the completely closed position, and indicating that the EGR valve is degraded responsive to the first EGR pressure being higher than a first threshold pressure. In any or all of the preceding examples, additionally or optionally, the indicating the presence of the degradation includes, estimating a second EGR pressure when the EGR valve is in the completely open position, and indicating that the EGR valve is degraded responsive to the second EGR pressure being lower than a second threshold pressure, the second threshold pressure higher than the first threshold pressure. In any or all of the preceding examples, additionally or optionally, the indicating the presence of the degradation further includes, indicating that the EGR valve is degraded responsive to a difference between the second EGR pressure and the first EGR pressure being lower than a threshold difference. In any or all of the preceding examples, additionally or optionally, the indicating the absence of the degradation includes, indicating that the EGR valve is not degraded responsive to each of the first EGR pressure being substantially equal to the first threshold pressure and the second EGR pressure being substantially equal to the second threshold pressure. In any or all of the preceding examples, additionally or optionally, each of the first EGR pressure and the second EGR pressure are estimated via a differential pressure sensor coupled across an orifice in the EGR passage. In any or all of the preceding examples, additionally or optionally, the first threshold pressure is established upon installation of the EGR valve by routing compressed air through the EGR passage with the EGR valve in the completely closed position and wherein the second threshold pressure is established upon installation of the EGR valve by routing compressed air through the EGR passage with the EGR valve in the completely open position, each of the first threshold and the second threshold estimated via the differential pressure sensor. In any or all of the preceding examples, the method further comprises, additionally or optionally, during an immediately subsequent engine operation, adjusting an engine air fuel ratio responsive to indication of presence of the degradation.

Another method for an engine comprises: in a first condition, closing an exhaust gas recirculation (EGR) valve positioned in an EGR passage, routing compressed air through the EGR passage, and indicating the EGR valve is stuck open responsive to a presence of pressure change in the EGR passage, and in a second condition, opening the EGR valve, routing compressed air through the EGR passage, and indicating the EGR valve is stuck closed in response to the absence of pressure change in the EGR passage. In any preceding example, additionally or optionally, the EGR passage is coupled between an intake of an engine and an exhaust of the engine, the engine propelling a vehicle, and for both the first operating condition and the second operating condition, the compressed air is routed by operating an electric booster coupled to the intake via an electric motor during a vehicle key-off condition. In any or all of the preceding examples, additionally or optionally, in the first condition the EGR valve is in an open position during the vehicle key-off condition and wherein in the second condition the EGR valve is in a closed position during the vehicle key-off condition. In any or all of the preceding examples, additionally or optionally, the presence of pressure change in the EGR passage includes a higher than threshold change in pressure across an orifice in the EGR passage after closing the EGR valve, and wherein the absence of pressure change in the EGR passage includes a lower than threshold change in pressure across the orifice in the EGR passage after opening the EGR valve. In any or all of the preceding examples, additionally or optionally, wherein the change in pressure is estimated via a differential pressure sensor coupled across the orifice in the EGR passage.

In yet another example, a hybrid vehicle system comprises: a vehicle, an engine including one or more cylinders, an intake manifold, and an exhaust manifold, an intake passage including a compressor and a charge air cooler (CAC) downstream of the compressor, a conduit coupled to the intake passage downstream of the compressor and upstream of the CAC, the conduit including a motor-driven electric booster, an electric booster bypass valve coupled at a junction of the intake passage and the conduit, an exhaust gas recirculation (EGR) passage coupling the exhaust manifold to the intake manifold, downstream of the compressor, the EGR passage including an EGR valve and an orifice, a differential pressure sensor coupled across the orifice in the EGR passage, and a controller with computer readable instructions stored on non-transitory memory for: while operating the electric booster during a vehicle key-off condition, commanding the EGR valve to a completely closed position, sensing EGR pressure via the differential pressure sensor after the commanded closing of the EGR valve, and indicating that the EGR valve is stuck at an open position in response to the sensed EGR pressure being higher than a first threshold pressure. In any preceding example, additionally or optionally, the controller includes further instructions for: while operating the electric booster during the vehicle key-off condition, commanding the EGR valve to a completely open position, sensing EGR pressure via the differential pressure sensor after the commanded opening of the EGR valve, and indicating that the EGR valve is stuck at the completely closed position in response to the sensed EGR pressure being lower than a second threshold pressure. In any or all of the preceding examples, additionally or optionally, each of the first threshold pressure and the second threshold pressure are calibrated during an engine-off condition within a threshold duration after installation of the EGR valve by operating the electric booster, the first threshold pressure being the differential pressure sensor reading with the EGR valve completely closed and the second threshold pressure being the differential pressure sensor reading with the EGR valve completely open. In any or all of the preceding examples, additionally or optionally, during the vehicle key-off condition, the one or more cylinders are parked with respective intake and exhaust valves in closed positions.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

while an engine is not combusting fuel, testing for degradation of an exhaust gas recirculation (EGR) valve coupled between an air intake and an exhaust of the engine;

during the test, turning the EGR valve to at least one predetermined position and forcing compressed air into the EGR valve; and indicating presence or absence of the degradation based on one or more pressure readings across the EGR valve;

wherein indicating the presence of the degradation includes estimating a first EGR pressure across the EGR valve when the EGR valve is in a completely closed position, and indicating that the EGR valve is degraded responsive to the first EGR pressure being higher than a first threshold pressure.

2. The method of claim 1, wherein the EGR valve is coupled to an EGR passage, the EGR passage configured to route at least a portion of exhaust gas from the exhaust to the air intake of the engine.

3. The method of claim 2, wherein forcing the compressed air includes forcing compressed air through the EGR passage by operating an electric booster via an electric motor, wherein the electric booster is coupled to a conduit parallel to the air intake, the conduit coupled to the air intake downstream of an intake compressor and upstream of a charge air cooler.

4. The method of claim 1, wherein the predetermined position includes one of the completely closed position and a completely open position.

5. The method of claim 1, wherein the indicating the presence of the degradation includes estimating a second EGR pressure across the EGR valve when the EGR valve is in the completely open position, and indicating that the EGR valve is degraded responsive to the second EGR pressure being lower than a second threshold pressure, the second threshold pressure higher than the first threshold pressure.

6. The method of claim 5, wherein the indicating the presence of the degradation further includes indicating that the EGR valve is degraded responsive to a difference between the second EGR pressure and the first EGR pressure being lower than a threshold difference.

7. The method of claim 5, wherein the indicating the absence of the degradation includes indicating that the EGR valve is not degraded responsive to each of the first EGR pressure being substantially equal to the first threshold pressure and the second EGR pressure being substantially equal to the second threshold pressure.

8. The method of claim 5, wherein each of the first EGR pressure and the second EGR pressure are estimated via a differential pressure sensor coupled across an orifice in the EGR passage.

9. The method of claim 5, wherein the first threshold pressure is established upon installation of the EGR valve by routing compressed air through the EGR passage with the EGR valve in the completely closed position and wherein the second threshold pressure is established upon installation of the EGR valve by routing compressed air through the EGR passage with the EGR valve in the completely open position, each of the first threshold and the second threshold estimated via the differential pressure sensor.

10. The method of claim 1, further comprising, during an immediately subsequent engine operation, adjusting an engine air fuel ratio responsive to indication of presence of the degradation.

11. A method comprising:

in a first condition, closing an exhaust gas recirculation (EGR) valve positioned in an EGR passage, routing compressed air through the EGR passage, and indicating the EGR valve is stuck open responsive to a presence of pressure change in the EGR passage; and in a second condition, opening the EGR valve, routing compressed air through the EGR passage, and indicating the EGR valve is stuck closed in response to an absence of pressure change in the EGR passage.

12. The method of claim 11, wherein the EGR passage is coupled between an intake of an engine and an exhaust of the engine, the engine propelling a vehicle, and wherein for both the first operating condition and the second operating condition, the compressed air is routed by operating an electric booster coupled to the intake via an electric motor during a vehicle key-off condition.

13. The method of claim 12, wherein in the first condition the EGR valve is in an open position during the vehicle key-off condition and wherein in the second condition the EGR valve is in a closed position during the vehicle key-off condition.

14. The method of claim 11, wherein the presence of pressure change in the EGR passage includes a higher than threshold change in pressure across an orifice in the EGR passage after closing the EGR valve, and wherein the absence of pressure change in the EGR passage includes a lower than threshold change in pressure across the orifice in the EGR passage after opening the EGR valve.

15. The method of claim 14, wherein the change in pressure is estimated via a differential pressure sensor coupled across the orifice in the EGR passage.

16. A hybrid vehicle system, comprising:

a vehicle;

an engine including one or more cylinders, an intake manifold, and an exhaust manifold;

an intake passage including a compressor and a charge air cooler (CAC) downstream of the compressor;

a conduit coupled to the intake passage downstream of the compressor and upstream of the CAC, the conduit including a motor-driven electric booster;

an electric booster bypass valve coupled at a junction of the intake passage and the conduit;

an exhaust gas recirculation (EGR) passage coupling the exhaust manifold to the intake manifold, downstream of the compressor, the EGR passage including an EGR valve and an orifice;

a differential pressure sensor coupled across the orifice in the EGR passage; and a controller with computer readable instructions stored on non-transitory memory for:

while operating the electric booster during a vehicle key-off condition, commanding the EGR valve to a completely closed position;

sensing EGR pressure via the differential pressure sensor after the commanded closing of the EGR valve; and indicating that the EGR valve is stuck at an open position in response to the sensed EGR pressure being higher than a first threshold pressure.

17. The system of claim 16, wherein the controller includes further instructions for:

while operating the electric booster during the vehicle key-off condition, commanding the EGR valve to a completely open position;

sensing EGR pressure via the differential pressure sensor after the commanded opening of the EGR valve; and indicating that the EGR valve is stuck at the completely closed position in response to the sensed EGR pressure being lower than a second threshold pressure.

18. The system of claim 17, wherein each of the first threshold pressure and the second threshold pressure are calibrated during an engine-off condition within a threshold duration after installation of the EGR valve by operating the electric booster, the first threshold pressure being the differential pressure sensor reading with the EGR valve completely closed and the second threshold pressure being the differential pressure sensor reading with the EGR valve completely open.

19. The system of claim 16, wherein during the vehicle key-off condition, the one or more cylinders are parked with respective intake and exhaust valves in closed positions.

* * * * *